US007121885B2

(12) United States Patent
Li et al.

(10) Patent No.: US 7,121,885 B2
(45) Date of Patent: Oct. 17, 2006

(54) CONNECTOR ASSEMBLY HAVING AUXILIARY DEVICE TO SUPPORT THE CONNECTOR AGAINST TILTING

(75) Inventors: Wei Li, Kunsan (CN); Chun-Sheng Li, Kunsan (CN)

(73) Assignee: Hon Hai Precision Ind. Co., Ltd, Taipei Hsien (TW)

( * ) Notice: Subject to any disclaimer, the term of this patent is extended or adjusted under 35 U.S.C. 154(b) by 0 days.

(21) Appl. No.: 11/148,677

(22) Filed: Jun. 8, 2005

(65) Prior Publication Data

US 2006/0068618 A1 Mar. 30, 2006

(30) Foreign Application Priority Data

Sep. 27, 2004 (CN) ..... 200400799389

(51) Int. Cl.
*H01R 13/648* (2006.01)

(52) U.S. Cl. ..... 439/607; 439/79; 439/80

(58) Field of Classification Search ..... 439/78, 439/80, 81, 82, 83, 84, 79, 607
See application file for complete search history.

(56) References Cited

U.S. PATENT DOCUMENTS 5,096,428 A * 3/1992 Lwee et al. ..... 439/79
6,109,981 A * 8/2000 Jin-ichi et al. ..... 439/733.1
6,676,449 B1 * 1/2004 Ji et al. ..... 439/607
2003/0119360 A1 * 6/2003 Jiang et al. ..... 439/607

* cited by examiner

*Primary Examiner*—Tulsidas C. Patel
*Assistant Examiner*—Vladimir Imas
(74) *Attorney, Agent, or Firm*—Wei Te Chung

(57) ABSTRACT

An electrical connector assembly (100) includes an electrical connector and an auxiliary supporter (6) detachably assembled to the connector. The connector includes a housing (2) comprising a mating portion (22) defining a mating port (223) opening to a front face (221) thereof and a mounting portion (21) extending down from a rear part of the mating portion to be mounted onto a printed circuit board (PCB) (10) to support the mating portion; and a plurality of terminals (4) received in the housing. Each terminal is provided with a contact portion (41) exposed in the mating port and a solder tail (42) extending out of the housing to be soldered to the PCB. The auxiliary supporter is provided with a stand adapted for standing on the PCB and an upholding portion (65) to hold a front part of the mating portion.

20 Claims, 6 Drawing Sheets

CONNECTOR ASSEMBLY HAVING AUXILIARY DEVICE TO SUPPORT THE CONNECTOR AGAINST TILTING

BACKGROUND OF THE INVENTION

1. Field of the Invention

The present invention relates to an electrical connector assembly having an auxiliary device assisting to support the electrical connector against tilting.

2. Description of Related Art

Signal transmission between electrical components are usually performed by a connector and a mating connector that electrically engage with each other. The connector commonly includes a mating portion for electrically engaging with the mating connector and a mounting portion for mounting to a printed circuit board (hereafter referred to as PCB). Wherein the mating portions of the connector are divided into two categories, one of which extend parallel to the PCB and the other of which extend perpendicularity to the PCB. That is to say, the former is plugged with its mating connector along a direction parallel to the PCB and the later is plugged with its mating connector along a direction perpendicular to the PCB.

U.S. Pat. No. 6,676,449 discloses a connector, a mating portion of which extends parallel to the PCB. The connector comprises a longitudinal housing, a plurality of terminals received in the housing, and a shell enclosing the housing. The housing has a base defining a mounting face to be mounted to the PCB, and a mating portion perpendicularly protruding from the base and defining a mating port therein to receive a mating connector. Each terminal comprises a solder foot extending out of the mounting face to be soldered to the PCB and a contact portion exposed in the mating port. In contrast with the base, the mating portion is impending from the PCB, thus the weight of the mating portion cause the connector to tilt down to that side the mating portion is set. That will make operation of soldering the solder feet of the terminals to the PCB become much more difficult. That even may cause the connector to be slantingly mounted on the PCB, thereby to make engagement between the connector and its mating connector become unreliable.

Therefore, to overcome above-mentioned disadvantages, an auxiliary device assisting to support the connector against tilting is desired.

SUMMARY OF THE INVENTION

An object of the present invention is to provide an electrical connector assembly having a mechanism assisting to support the electrical connector against tilting.

Another object of the present invention is to provide an electrical connector assembly, wherein the electrical connector is well mounted on a PCB to perform a reliable electrical engagement with its mating connector.

Accordingly, to achieve the above objects, an electrical connector assembly of present invention includes an electrical connector and an auxiliary supporter detachably assembled to the connector. The connector includes a housing comprising a mating portion with a mating port opening to a front face thereof and a mounting portion extending down from a rear part of the mating portion to be mounted onto a PCB to support the mating portion; and a plurality of terminals received in the housing. Each terminal is provided with a contact portion exposed in the mating port and a solder tail extending out of the housing to be soldered to the PCB. The auxiliary supporter is provided with a stand adapted for standing on the PCB and an upholding portion to hold a front part of the mating portion.

Other objects, advantages and novel features of the present invention will become more apparent from the following detailed description of the present embodiment when taken in conjunction with the accompanying drawings.

DETAILED DESCRIPTION OF THE INVENTION

Figure 1:
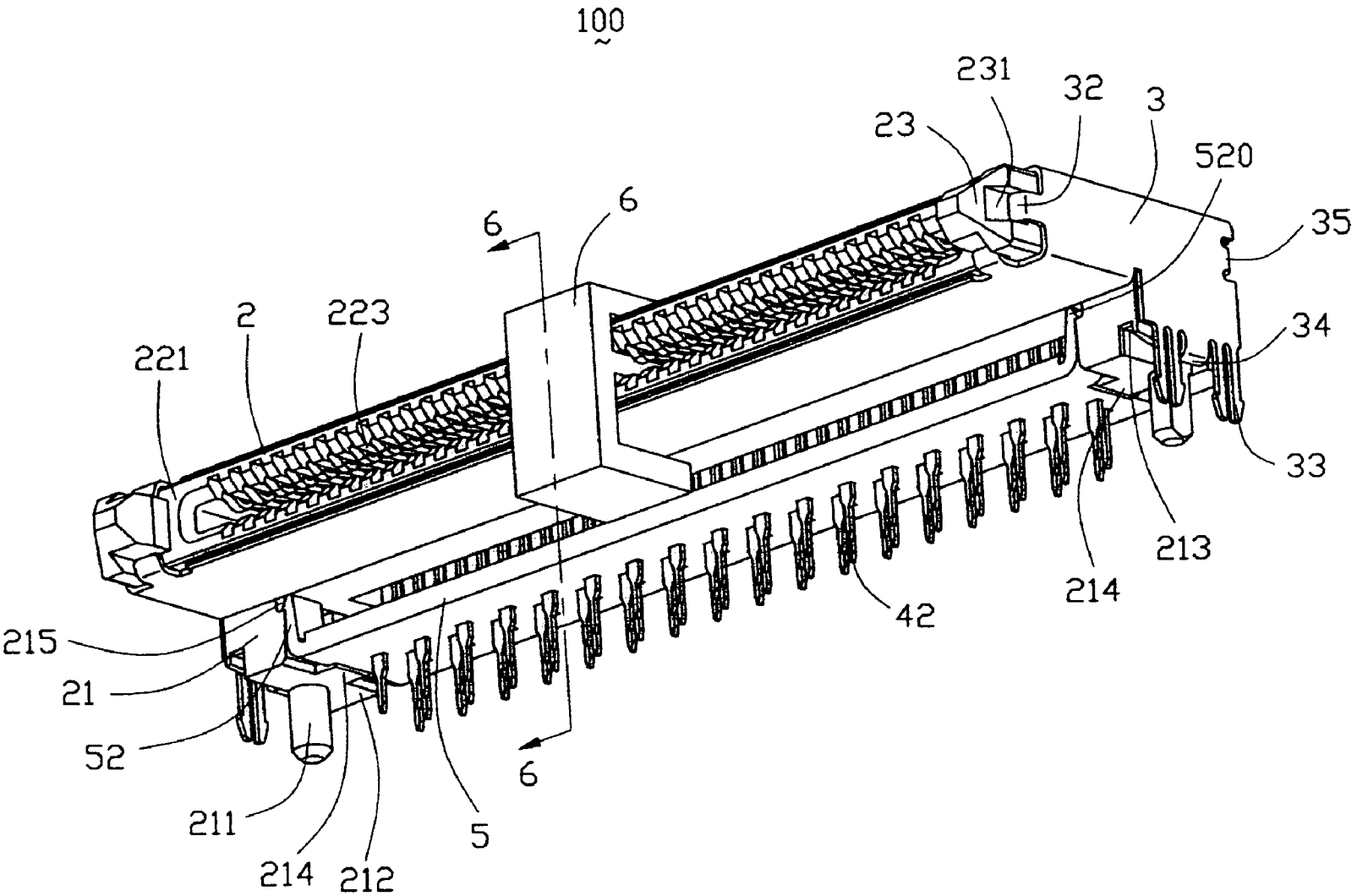
FIG. 1 is a perspective view of an electrical connector assembly comprising an electrical connector and an auxiliary supporter assisting to support the electrical connector against tilting according to an exemplary embodiment of the present invention.

Reference will now be made to the drawing figures to describe the present invention in detail.

Referring to FIG. 1, an electrical connector assembly 100 according to an exemplary embodiment of the present invention includes an electrical connector (not labeled) and an auxiliary supporter 6. The electrical connector comprises a housing 2, a plurality of terminals 4 received in the housing 2, a shell 3 attached to the periphery of the housing 2 and enclosing the housing 2 thereby to shield the terminals 4 therein, and an aligning plate 5.

Figure 2:
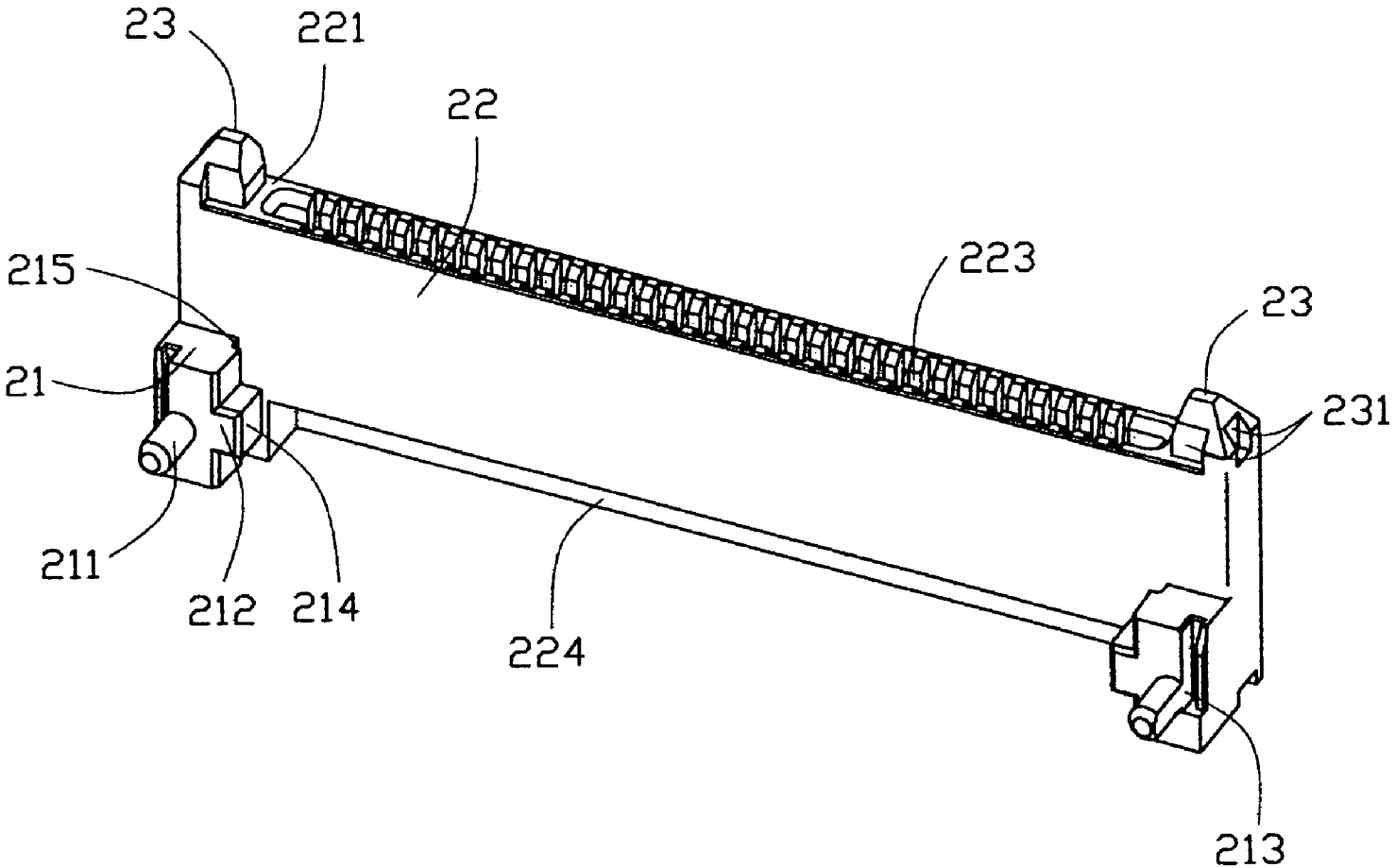
FIG. 2 is a perspective view of a housing of the electrical connector of FIG. 1.
Figure 6:
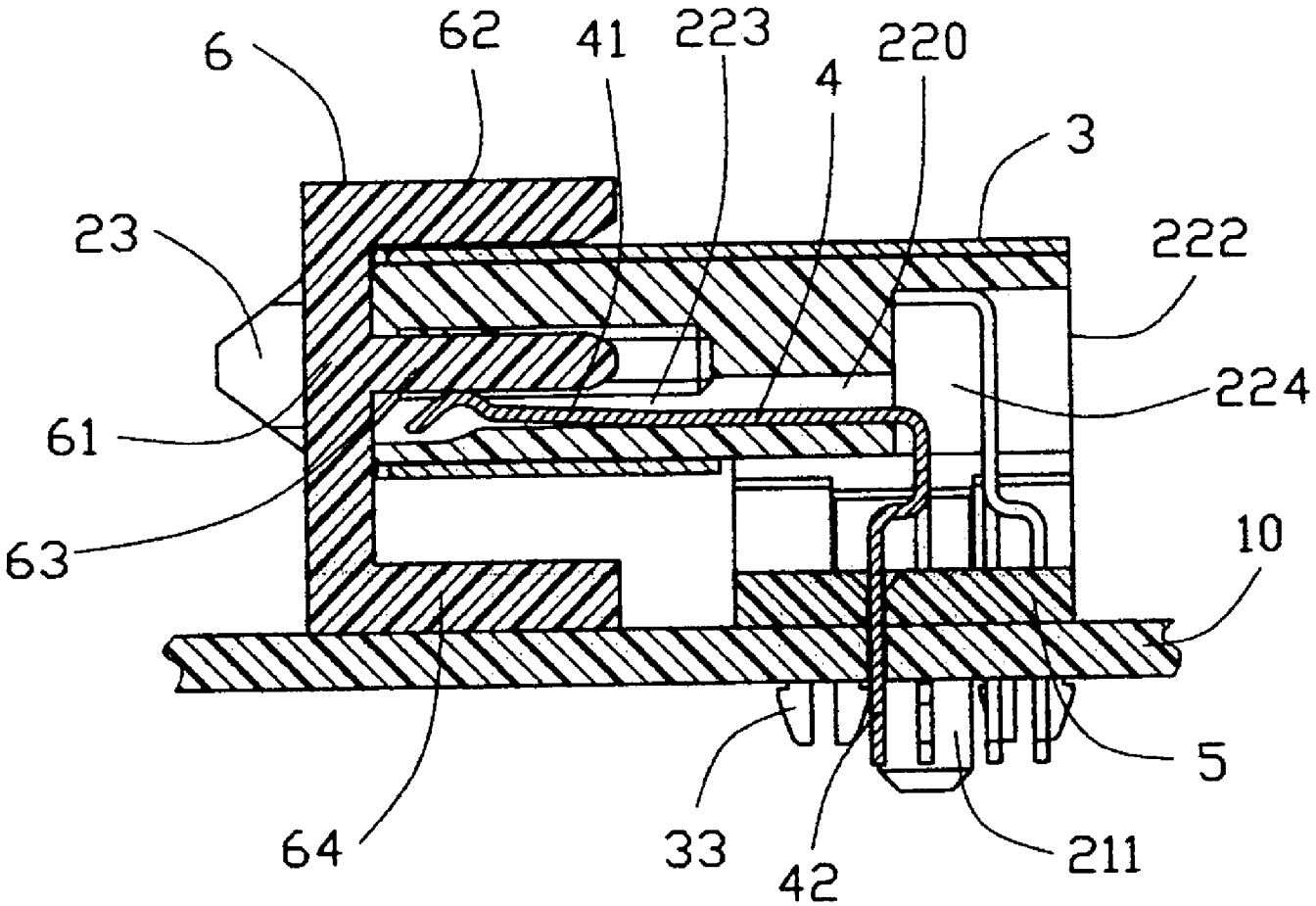
FIG. 6 is a sectional view of the electrical connector assembly of FIG. 1 after being mounted on a PCB, taken along line 6—6.

Referring to FIGS. 1, 2 and 6 together, the housing 2 comprises a longitudinal mating portion 22 with a mating face 221 and a back face 222, and a pair of support blocks 21 extending down from a rear part of the mating portion 22 that is adjacent to the back face 222, to be mounted onto a PCB 10. The mating portion 22 defines a slot 220, a front sect of which serves as a mating port 223 opened to the mating face 221 to receive a mating portion of a mating connector (not shown), and a rear sect of which extends down to communicate a gap between the pair of support blocks 21 to form a terminal tail receiving space 224. At two longitudinal ends of the mating port 223 respectively rise a tapered guiding-post 23 for guiding the mating connector.

Each terminal 4 is provided with a contact portion 41 exposed in the mating port 223 to electrically connect a conductor of the mating connector received therein, and a solder tail 42 extending from the contact portion 41 down to be soldered to the PCB 10. There are two rows of terminals 4, one row of which have the contact portions 41 thereof attached to an upper wall (not labeled) of the mating port 223 and the other row of which have the contact portions 41 thereof attached to a bottom wall (not labeled) of the mating port 223, and both rows of which have the solder tails 42 thereof spacedly accommodated in the terminal tail receiving space 22. Wherein the contact portions 41 on the upper wall and the contact portion 41 on the bottom wall are alternately arranged along the longitudinal direction of the mating portion 22.

Figure 3:
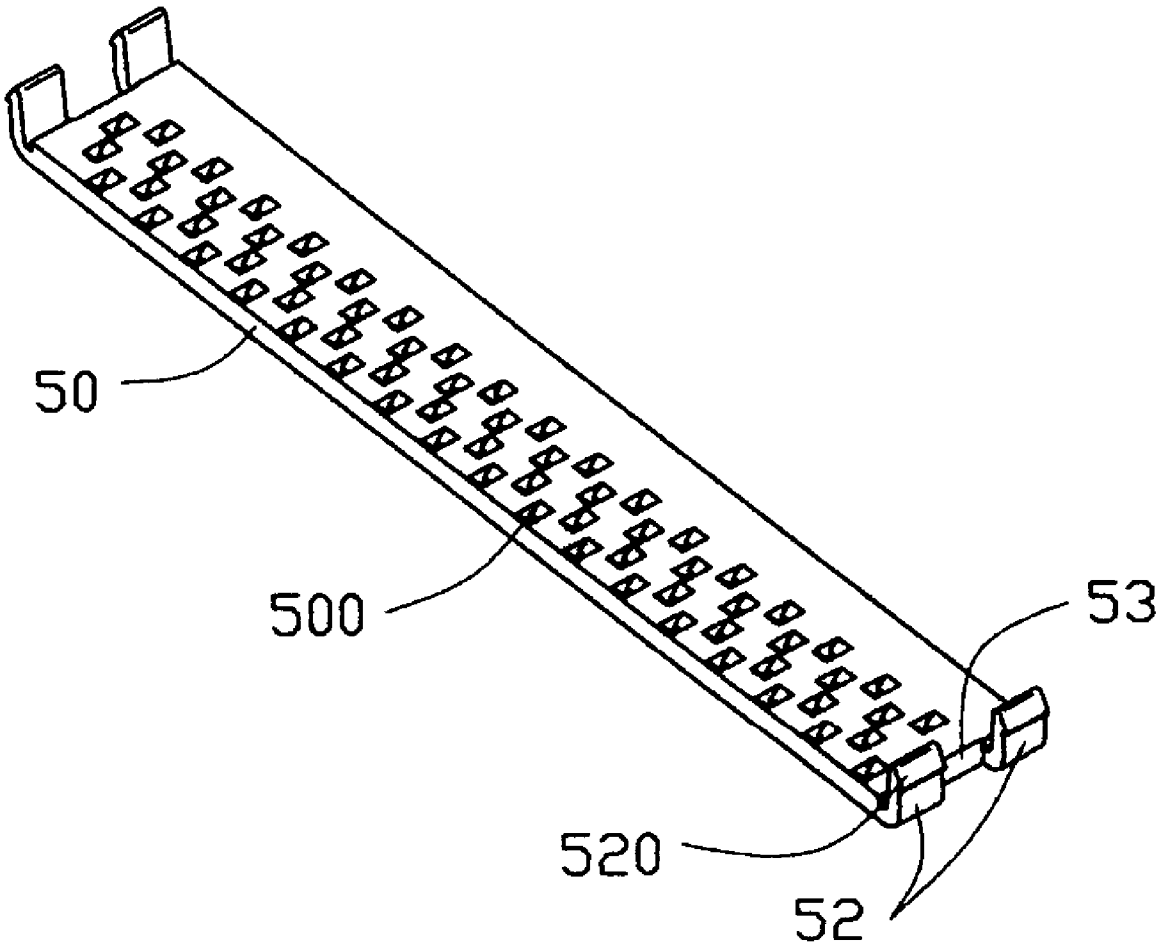
FIG. 3 is a perspective view of an aligning plate of the electrical connector assembly of FIG. 1.

Referring to FIGS. 1, 2 and 3, the aligning plate 5 comprises a flat plate 50 defining through holes 500 therein corresponding to the solder tails 42 of the terminals 4, and two pair of retaining ears 52 extending upwards from the flat plate 50 respectively at each longitudinal ends thereof, each of which define a cutout 53 therebetween. Each retaining ear 52 has an outwards clasp 520 at an end thereof. The aligning plate 5 is placed in the gap between the pair of support blocks 21 with each of the cutouts 53 thereof receiving a block 214 protruding from the support block 21, and the clasp 520 thereof held in a recess 215 defined in the support block 21. Thereby the aligning plate 5 is sturdily fixed to the housing 2. On the other hand, the solder tails 42 of the terminals 4 pass the corresponding holes 500 in the aligning plate 5 and are fixed thereby, thereby the alignment of the solder tails 42 are ensured or further strengthened. Tips of the solder tails 42 that passed through the aligning plate 5 are soldered to the PCB 10, as shown in FIG. 6. As the aligning plate 5 is fixed there to be flush with the pair of support blocks 21, an under surface thereof is integrated with under surfaces of the support blocks 21 to form a flat mounting surface to be mounted onto the PCB 10. Additionally, each support block 21 has a positioning post 211 extending down from the under surface thereof, for positioning the connector to the PCB 10.

Figure 4:
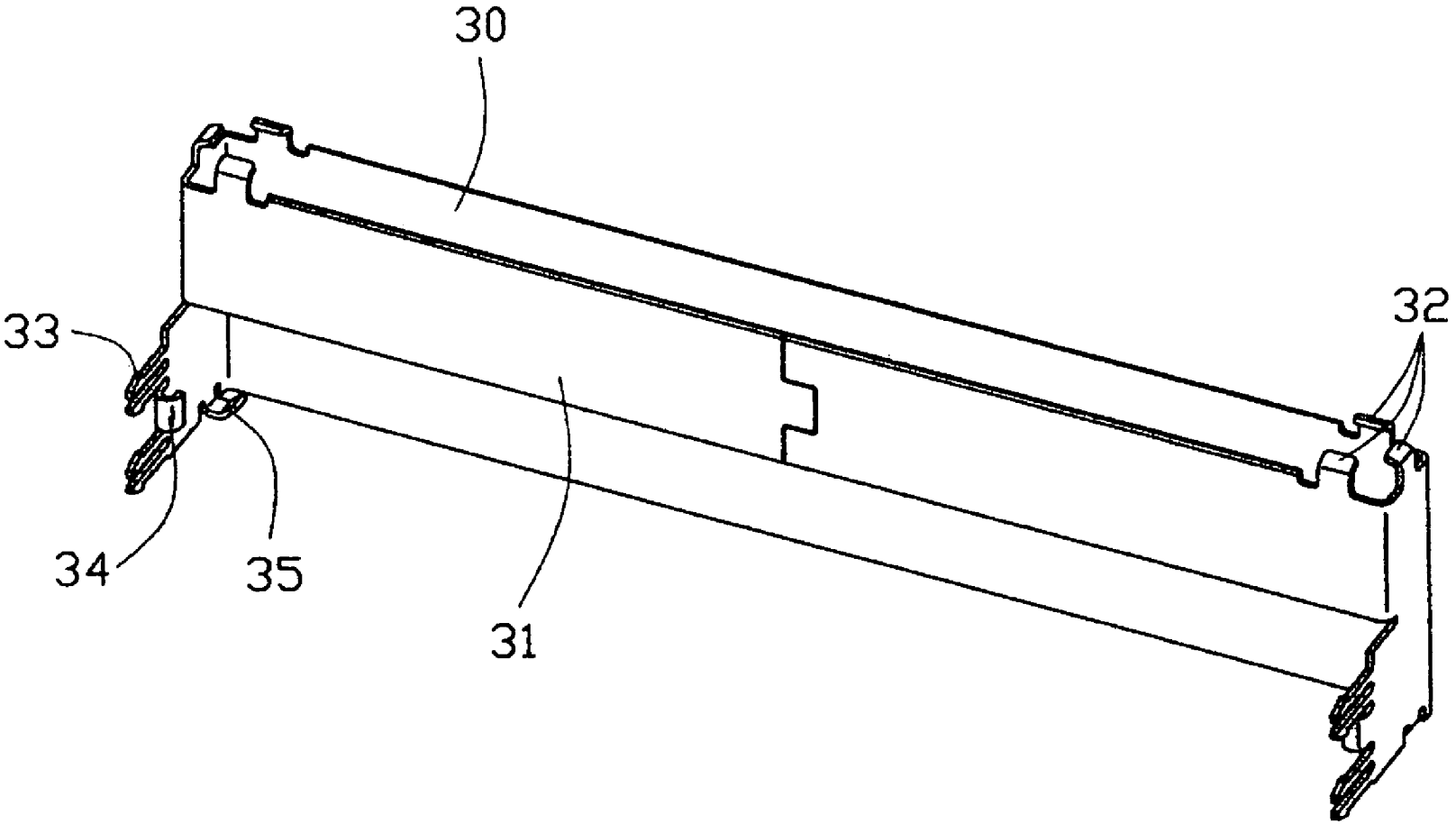
FIG. 4 is a perspective view of a shell of the electrical connector of FIG. 1.

Referring to FIGS. 1, 2 and 4, the shell 3 is a rectangular cannula 31 with a rectangular hollow 30 therein for fitly accommodating the mating portion 22 of the housing 2, which is formed by joining two ends of a metal sheet. The shell 3 is put onto the housing 2 from a side adjacent to the mating face 221. During this process, the mating portion 22 of the housing 2 passes the hollow 30 until clasps 32 at the shell 3 are locked in notches 231 formed in the guiding-post 23 of the housing 2. The shell 2 has two pair of grounding feet 32 integrally extending from two longitudinal ends of the rectangular cannula 31 respectively, to be soldered to the PCB 10 as well as the solder tails 42 of the terminals 4. There is a pair of hooks 34 formed between each pair of grounding feet 33 to slide into a cutout 213 in the support block 21 to be locked therein, and a pair of detaining pieces 35 extending from the root of each pair of grounding feet 33 to be bent to abut against the back surface 222 of the housing 2 after the shell 3 is fitly attached on the periphery of the housing 2, to detain the shell 3 on the housing 2 against backwards coming off. Thus, the housing 2 with terminals 4 therein is well enclosed by the shell 3.

Figure 5:
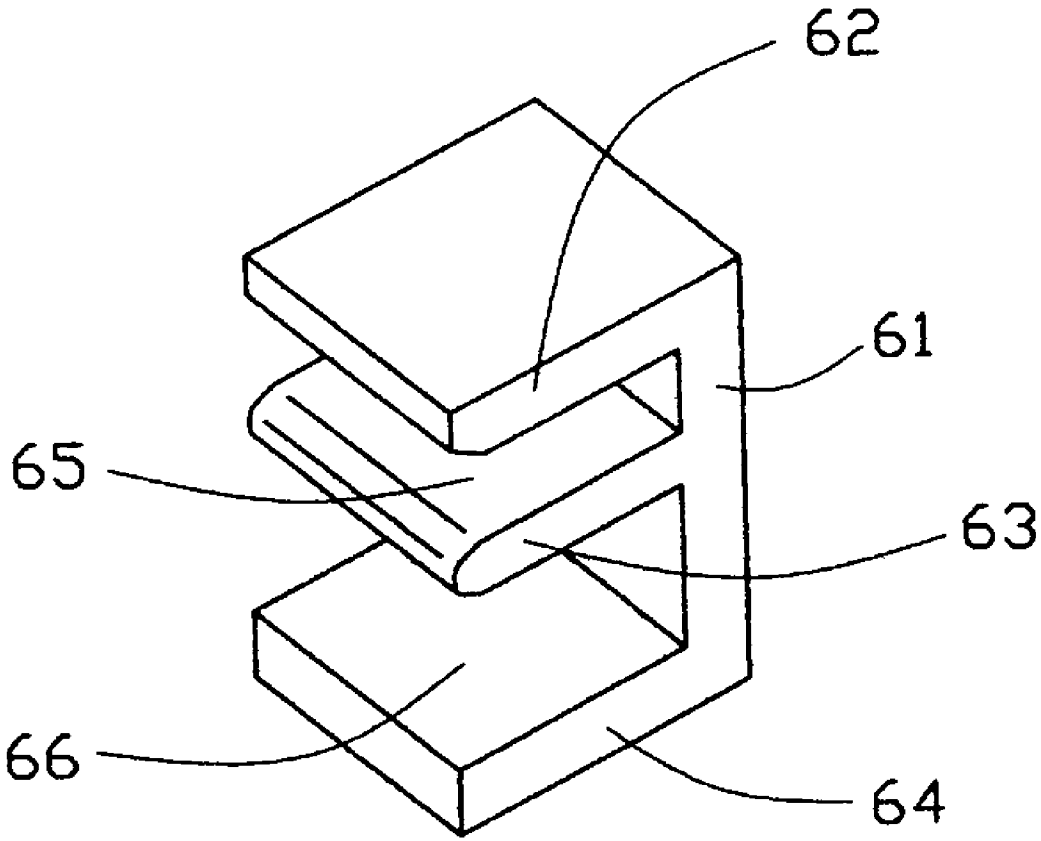
FIG. 5 is a perspective view of the auxiliary supporter of FIG. 1.

Referring to FIG. 5, the auxiliary supporter 6 is of an E-shaped structure comprising a standing trunk portion 61, and three flat plates 62, 63, 64 parallel extending from a same side of the trunk portion 61, which define an upper notch 65 between the plates 62, 63 and a lower notch 66 between the plates 63, 64. Referring to FIGS. 1 and 6, the auxiliary supporter 6 is assembled to the connector with the tapered middle plate 63 thereof being inserted into the mating port 223, while the upper notch 65 and the lower notch 66 thereof respectively receiving the upper wall and the bottom wall of the mating port 223. As the auxiliary supporter 6 is configured that an under surface thereof, viz. an under surface of the lower plate 64 in this embodiment, is coplanar with the mounting surface defined by the aligning plate 5 and the support blocks 21, and the middle plate 63 thereof is just fit to support the upper wall of the mating port 223 after the lower plate 64 thereof is mounted onto the PCB 10, thus the connector is steadily set on the PCB 10 without tilting off via the auxiliary supporter 6. Thereby, the operation of soldering the solder tails 42 and grounding feet 33 of the connector to the PCB 10 become more easily, and the connector mounted on the PCB 10 will not be slant anymore, therefore ensuring a reliable electrical engagement between the connector and its mating connector. After the solder tails 42 and grounding feet 33 are soldered to the PCB 10, thereby the connector is fixed on the PCB to engage with a mating connector, the auxiliary supporter 6 can be detached therefrom.

The disclosure is illustrative only, changes may made in detail, especially in matter of shape, size, and arrangement of parts within the principles of the invention. For example, the auxiliary supporter 6 can be of a ⊂-shaped structure or a Γ-shaped structure, or the like if only provided with a stand having an under surface coplanar with the mounting surface of the connector and an upholding portion to hold the mating portion of the connector. Otherwise, the mating portion of the connector can be a tongue plate, and the terminals are arranged on two opposite sides of the tongue plate.

What is claimed is:

1. An electrical connector assembly comprising:

an electrical connector comprising:

a housing including a mounting portion defining a mounting surface adapted for mounting on a printed circuit board (PCB), and a mating portion extending forwardly from the mounting portion and defining a mating port, any portion of the mating portion located above the mounting surface; and terminals received in the housing, each terminal having a contact portion exposed in the mating port and a solder tail extending beyond the mounting surface and adapted to be soldered to the PCB; and an auxiliary supporter detachably assembled to the connector and provided with a supporting surface coplanar with the mounting surface, wherein the supporting surface of the auxiliary supporter is provided by a root plate vertically overlapped under the mating portion.

2. The electrical connector assembly as described in claim 1, wherein the mating portion extends parallel to the mounting surface.

3. The electrical connector assembly as described in claim 1, wherein the auxiliary supporter comprises a standing trunk adapted for standing on the PCB and a limb extending into the mating port of the connector.

4. The electrical connector assembly as described in claim 1, wherein the auxiliary supporter has a top plate extending onto an exterior upper surface of the connector.

5. The electrical connector assembly as described in claim 1, wherein the auxiliary supporter is substantially of an E-shaped structure.

6. An electrical connector assembly comprising:

a one-piece unitary printed circuit board, an electrical connector mounted upon the printed circuit board and comprising:

a housing unit defining a mounting portion seated upon the printed circuit board and a mating portion extending forwardly from the mounting portion, substantially in a cantilever manner spaced from the printed circuit board thereunder, with a mating port which defines a mating direction along a front-to-back direction;

a plurality of terminals disposed in the housing unit, each of said terminals including a contact portion located in the mating portion and exposed to the mating port, and a tail portion located around the mounting portion and connected to the printed circuit board; and an auxiliary supporter detachably assembled to the connector; wherein said supporter provides a supporting surface, other than the mounting portion, which is located in front of the mounting portion and abuts against the printed circuit board for facilitating reliably assembling the connector to the printed circuit board, but will be removed during normal use.

7. The connector assembly as claimed in claim 6, wherein said auxiliary supporter is detachably attached to the mating portion.

8. The connector assembly as claimed in claim 7, wherein said auxiliary supporter covers a portion of the mating port.

9. The connector assembly as claimed in claim 7, wherein said auxiliary supporter is attached to the mating portion along the front-to-back direction.

10. The connector assembly as claimed in claim 7, wherein said auxiliary supporter itself is fully overlapped with the mating portion in a vertical direction.

11. The connector assembly as claimed in claim 7, wherein said auxiliary supporter is not engaged or connected with the mounting portion.

12. The connector assembly as claimed in claim 6, wherein said housing unit further includes a metallic shield covering at least one of said mounting portion and said mating portion.

13. The connector assembly as claimed in claim 6, wherein any portion of the auxiliary supporter is located above the printed circuit board.

14. An electrical connector assembly comprising:

an electrical connector comprising:

an insulative housing defining a mounting portion with a mounting face for being seated upon a printed circuit board under a condition that said mounting face is essentially located at a lower level of the housing, and a mating portion extending forwardly from the mounting portion substantially in a cantilever manner, with a mating port which defines a mating direction along a front-to-back direction and positioned entirely higher than said lower level; and a plurality of terminals received in the housing, each terminal provided with a contact portion located in the mating port and a solder tail extending out of the housing and adapted to be soldered to the printed circuit board; and an auxiliary supporter detachably assembled to the connector, and provided with a stand adapted for standing on the printed circuit board.

15. The connector assembly as claimed in claim 14, wherein said auxiliary supporter includes a top plate covering on an exterior upper surface of the connector.

16. The connector assembly as claimed in claim 14, wherein the auxiliary supporter further comprises a tab extending into the mating port.

17. The connector assembly as claimed in claim 14, wherein said stand of the auxiliary supporter stands in front of the mating portion and covers a portion of the mating port.

18. The connector assembly as claimed in claim 14, wherein any portion of the auxiliary supporter is located above the printed circuit board.

19. The electrical connector assembly as described in claim 14, wherein the auxiliary supporter further comprises a root plate vertically overlapped under the mating portion.

20. The connector assembly as claimed in claim 6, wherein said auxiliary supporter is substantially of an E-shaped structure.

* * * * *